United States Patent [19]

Klein

[11] 4,306,120

[45] Dec. 15, 1981

[54] SOUND EMITTER

[76] Inventor: Siegfried Klein, 42 rue de la Tour d'Auvergne, Paris 75009, France

[21] Appl. No.: 137,613

[22] Filed: Mar. 31, 1980

[30] Foreign Application Priority Data

Apr. 13, 1979 [FR] France ..... 79 09450

[51] Int. Cl.[3] ..... H04R 23/00

[52] U.S. Cl. ..... 179/113

[58] Field of Search ..... 179/113

*Primary Examiner*—George G. Stellar

*Attorney, Agent, or Firm*—Michael J. Striker

[57] ABSTRACT

Sound emitter comprising a circuit generating an electrical signal at high frequency and high voltage, which is modulated by a low frequency signal which is to be transformed into sound waves, and which is applied to a corona-effect transducer at the input of an exponential horn.

Transducer appears in the form of a cylindrical cartridge which is mounted slidably in a passage in the housing of the emitter, and one end of which is engaged in an accommodation provided at the input of the horn, while its other end projects beyond the outer end of passage; the discharge electrode has a cylindrical contact part which is exposed in an intermediate zone of the transducer, between the accommodation and the inner end of the passage; a metal contact member is electrically connected to the output of the generating circuit and is in sliding contact with the contact part of electrode; a metal plug is fixed detachably at the outer end of said passage and holds the transducer in place axially.

10 Claims, 2 Drawing Figures

1
2
3
4
5
6
7
8
9
10
11
12
13
14
15
16
17
18
19
20
21
22
23
24
25
26
27
28
29
30
31

SOUND EMITTER

BACKGROUND OF THE INVENTION

The present invention relates to a sound emitter of the type comprising a metal chassis supporting a circuit generating an electrical signal at high frequency and high voltage, which is modiated by a signal at lower frequency that is to be transformed into sound waves, a metal housing fixed detachably to the chassis and forming with the latter a completely closed shielding that encloses the said generating circuit, a metal horn of exponential form which extends into the interior of the metal housing, and of which the output end through an opening in the housing, and a corona-effect transducer containing a tube made of an electrically insulating material resistant to high temperature, which is mounted at the input to the exponential horn and in the bore of which there extends a discharge electrode electrically connected to the output of the said generating circuit and having a tip disposed in proximity to the input end of the horn.

Sound emitters of the above-indicated type, using a modulated corona discharge to cause the ambient air to vibrate and obtain sounds of remarkable purity, are known as "IONOPHONES" and are described, in particular, in French Pat. No. 1,041,790 and the certificates of addition attached thereto of the Applicant.

In known sound emitters of the above type, the tip of the discharge electrode, and the adjacent components, are exposed to a high temperature while in operation, so that these components end up by becoming deteriorated in the long run. In practice it is necessary to replace the corona-effect transducer or at least a part of the latter approximately every two thousand hours. Nevertheless, in known sound emitters of the above type, the replacement of the worn corona-effect transducer by a new transducer, was a relatively complicated operation that had to be done by a specialist, because of the very method of construction of the corona-effect transducer and its method of installation in the emitter. Furthermore, for a given HF power, known transducers have a relatively low efficiency.

DESCRIPTION OF THE INVENTION

The present invention, therefore, is intended to remedy this drawback by providing a sound emitter of the type defined above, in which the corona-effect transducer can very easily be replaced, even by an unskilled person.

Another object of the present invention is to provide a corona-effect transducer with high electro-acoustical efficiency.

With this in mind, the sound emitter according to the present invention is characterized in that the horn has, at its input end, a cylindrical accommodation coaxial to the lontitudinal axis of the horn, in that the housing has a cylindrical passage which is axially spaced and aligned with the said cylindrical accommodation, and in that the said transducer appears in the form of a cylindrical cartridge which is mounted to slide in the said passage in the housing, and one end of which is engaged in the said accommodation, while its other end projects beyond the outer end of the said passage, the said electrode having a cylindrical contact part exposed in an intermediate zone of the cylindrical surface of the said cartridge-shaped transducer, between the said cylindrical accommodation and the inner end of the said passage, in that there is a metal contact member provided which is electrically connected to the output of the said generating circuit, and which is in sliding contact with the said cylindrical contact part of the electrode, in that a metal plug is fixed detachably at the outer end of the said passage and keeps the said cartridge-shaped transducer in place axially.

Thanks to such an arrangement, in order to replace the corona-effect transducer, it is sufficient to withdraw the metal plug, grasp the projecting end of the worn transducer and bring it out of the emitter, introduce a new transducer, in its stead, and replace the metal plug. It is quite clear that these operations do not call for any particular skill.

Furthermore, according to a preferred embodiment of the invention, the electro-acoustical efficiency of the transducer can be greatly improved by giving a low value, for example of 1 to 2 mm, to the diameter of the bore in the insulating tube surrounding the tip of the discharge electrode, and, owing to the fact that the metal horn, its accommodation and a metal coating that may be provided on the insulating tube and in contact with the accommodation, form a radiator which quickly evacuates the heat units produced by the corona discharge in the transducer, and which consequently, reduces the thermal inertia of the latter. Thus, fluctuations in temperature and hence in pressure, will faithfully follow the fluctuations of the signal modulating the corona discharge.

DESCRIPTION OF THE DRAWINGS

A form of execution of the present invention will now be described with reference to the attached drawing in which:

The sound emitter represented in FIG. 1 comprises a chassis 1 on the upper plate 2 of which there is mounted a circuit 3 generating an electrical signal at high frequency and high voltage, which is modulated by a lower-frequency signal which is to be transformed into sound waves. The wiring diagram of such a circuit is described, for example, in the abovementioned French patent, to which reference can be made for more details. FIG. 1 simply shows the output coil 4 of the circuit 3 from which is taken the high-frequency high-voltage electrical signal modulated by the low frequency signal, and which is connected electrically to a corona-effect transducer 5 in a manner to be described below.

Figures 1, 2:
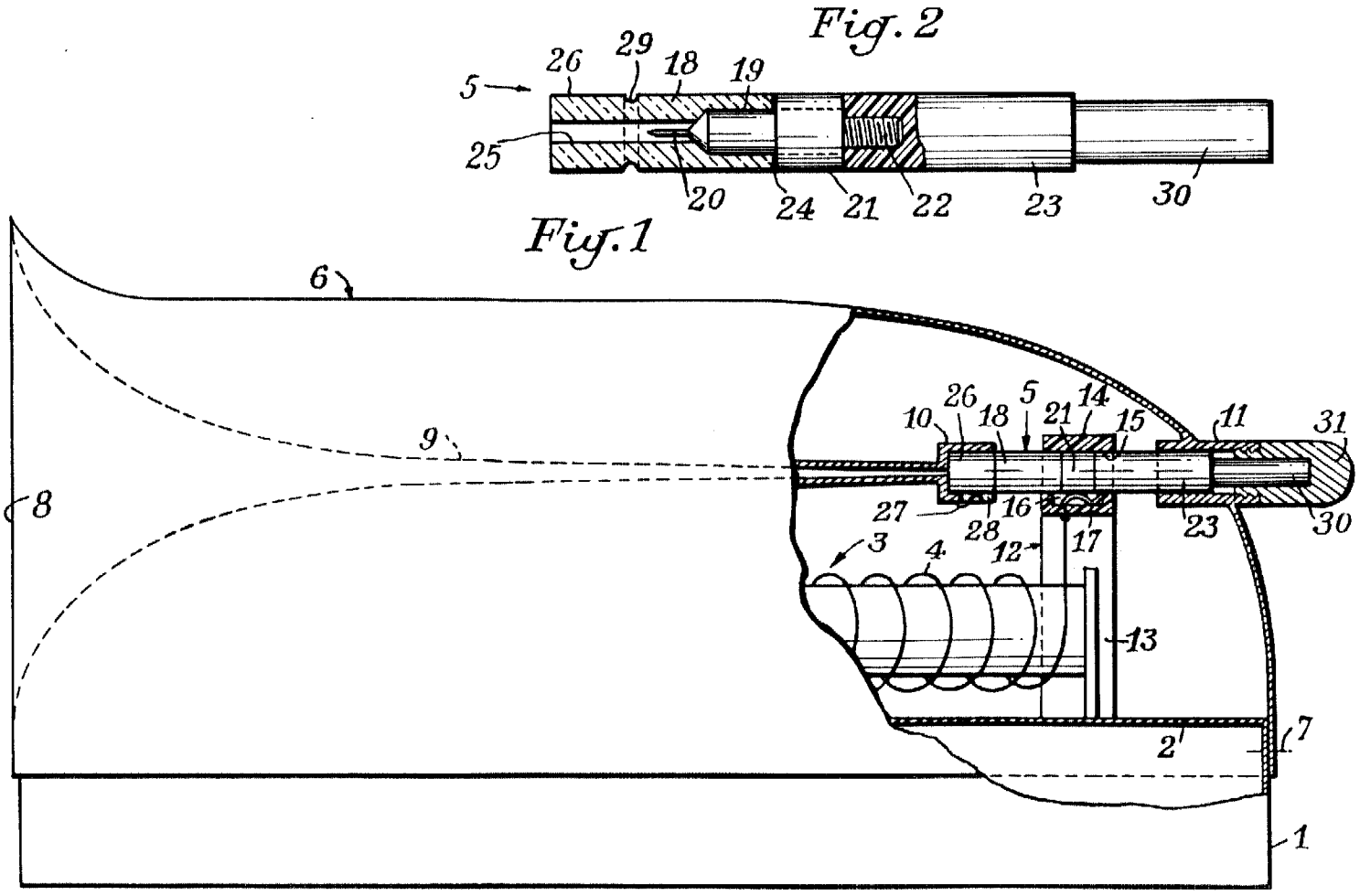
FIG. 1 is a view, partly in elevation and partly in section, of a sound emitter according to the present invention.
FIG. 2 is a view on an enlarged scale, partly in section and partly in elevation, showing the corona-effect transducer used in the emitter represented in FIG. 1.

A metal housing 6 is fixed detachably to chassis 1, for example, by screws 7. Housing 6 forms, with the upper plate 2 of chassis 1, a completely closed shielding, preventing the propagation to the outside of the electromagnetic waves which are emitted by circuit 3, and which could otherwise distupt the working of domestic appliances, such as a television receiver, situated in the vicinity of the emitter. Housing 6 is provided with a lateral opening 8, on the edge of which there is connected, for example by welding, the edge of the belled output end of a metal horn 9, of exponential form, which extends in a substantially horizontal direction into the interior of housing 6.

The inner end or input end of horn 9 is enlarged in such a way as to form a cylindrical accommodation 10, coaxial to the longitudinal axis of horn 9. On the side opposite opening 8, the housing 6 has a cylindrical passage 11 which is in axial alignment with the cylindrical accommodation 10. Between passage 11 and accommodation 10 there is a support 12 made of an insulating material having a high dielectric constant, for example, of "Teflon." Support 12 has, for example, the form of a gallows whose vertical upright 13 is fixed to the upper plate 2 of chassis 1, beside one end of coil 4 and whose horizontal arm 14 is pierced with a cylindrical hole 15 aligned axially with accommodation 10 and passage 11. In the bottom of hole 15, a cavity 16 is formed, in which there is lodged a metal contact member 17 embodied, for example, in the form of a spring leaf projecting slightly into the interior of hole 15. One end of spring leaf 17 projects below horizontal arm 14 and forms a connecting thimble to which is fixed, for example by welding, one end of the conductor wire forming the coil 4.

As it can be seen more particularly in FIG. 2, the corona-effect transducer 5 appears in the form of a cylindrical cartridge. It comprises a tube 18 made of an electrically insulating material capable of withstanding a high temperature. For example, tube 18 can be embodied by quartz or alumina. In the bore in tube 18 there is engaged a discharge electrode 19 terminated by a fine tip 20. Electrode 19 and tip 20 are embodied of a metal having a high melting point, for example of "Kantal." Electrode 19 has a part 21 of larger outside diameter, which can be integral with electrode 19 or formed by a ring made of a metal which is a good conductor, for example of copper, which has an axial length shorter than that of electrode 19, and which is force-fitted over the latter. Electrode 19 is prolonged, on the side opposite tip 20, by a threaded rod 22 on which is screwed a cylindrical piece 23 made of an insulating material having a high dielectric constant, for example, of "Teflon".

Part 21 of electrode 19 and tube 18 are connected together, for example by means of an appropriate cement 24. As a variation, electrode 19 can be threaded on the outside, and tube 18 can be tapped on the inside to permit their connection.

Part 25 of the bore in tube 18 surrounding tip 20 of electrode 19, and extending to the end of the tube opposite that which adjoins part 21 of electrode 19, has a small diameter so that the volume of air to be heated by the corona discharge produced while in operation by tip 20, will be small and consequently so that the fluctuations in the pressure of the air made to vibrate in bore 25 by the modulated corona discharge will be as great as possible. For example, the diameter of bore 25 can be comprised between about 1 mm and about 2 mm.

As shown in FIG. 2, the cylindrical part 21 of electrode 19, the tube 18 and insulating piece 23 have equal outer diameters. Thus the peripheral surface of cylindrical part 21 is flush with the cylindrical surface of the corona-effect transducer 5 in an intermediate zone of the latter, and forms a surface of contact that permits the electrical connection of electrode 19 with coil 4. As a matter of fact, as shown in FIG. 1, transducer 5 is mounted to slide in passage 11 and in hole 15 of support 12, and the front end of tube 18 is engaged in accommodation 10. In this position, the part 21 of electrode 19 is in sliding contact with spring-leaf 17, thereby insuring electrical connection between electrode 19 and coil 4.

Preferably, the end part of tube 18 which is engaged in accommodation 10 is coated with a thin metal layer 26 on its peripheral surface. A metal contact member 27, embodied, for example, in the form of a spring-leaf and fixed, for example, by welding on the outside of accommodation 10, penetrates into a slot 28, formed longitudinally in the peripheral wall of accommodation 10 and comes in contact with metal layer 26. Since horn 9 is grounded, the metal layer 26 is thus grounded. Thus, the metal layer forms a counter-electrode which, when in operation cooperates with the tip 20 of electrode 19, which is brought to an HF potential on the order of several thousand volts, in order to create an electrical field of sufficient intensity to produce a corona discharge at the end of tip 20. In order to increase the electrical field and facilitate the priming of the corona discharge, a circular groove 29 can be formed in the peripheral surface of tube 18, slightly ahead of tip 20, as shown in FIG. 2, and the metal layer 26 extends to the bottom of the said groove.

As a variation, it would also be possible to dispense with metal layer 26 and spring leaf 27, if the outer diameter of tube 18, and the inner diameter of accommodation 10 were machined with sufficient precision for tube 18 to be engaged with mild friction in accommodation 10, and be in close contact with the wall of the latter. In this case, the counter-electrode is formed by the cylindrical wall of accommodation 10.

As indicated above, the metal layer 26 and/or the metal horn 9 and its accommodation 10, which is in contact with layer 26, also form a radiator insuring a rapid evacuation of the heat units generated by the corona discharge in bore 25.

Although it is not shown in FIG. 1, the mouth of accommodation 10 can be flared to facilitate the introduction into the latter of the front end of tube 18.

As shown in FIG. 1, the end 30 of insulating piece 23 projects beyond the outer end of passage 11. A metal plug 31 is fixed detachably, for example by screwing, to the outer end of passage 11 and holds the cartridge-shaped transducer 5 in place axially. Thus, after removal of plug 31, transducer 5 can easily be extracted from the emitter and replaced, in case of need, by a new transducer. A coil compression spring (not shown) may be provided between the terminal face of end 30 of insulating piece 23 and the bottom of plug 31, in order to urge transducer 5 elastically against the base of accommodation 10, and to compensate for axial play.

It is clearly understood that the form of execution of the present invention which was described above, was given by way of purely indicative and in nonlimiting example, and that numerous modifications can be made without thereby departing from the scope of the present invention.

What is claimed is:

1. Sound emitter comprising a metal chassis that supports a circuit generating an electrical signal at high frequency and high voltage, which is modulated by a signal at lower frequency that is to be transformed into sound waves, a metal housing fixed detachably to the frame and forming with the latter a completely closed shielding that encloses said generating circuit, a metal horn of exponential form, which extends into the interior of the metal housing and whose output end opens through an opening in the housing, and a corona-effect transducer consisting of a tube made of an electrically insulating material, resistant to high temperature, which is mounted at the input of the exponential horn and in the bore of which there extends a discharge electrode connected electrically to the output of said generating circuit and having a tip disposed in proximity to the input end of the horn, said horn having, at its input end, a cylindrical accommodation coaxial to the longitudinal axis of the horn, said housing having a cylindrical passage which is axially spaced and aligned with the said cylindrical accommodation, said transducer being in the form of a cylindrical cartridge which is mounted slidably in the said passage of the housing and one end of which is engaged in the said accommodation while its other end projects beyond the outer end of the said passage, said electrode having a cylindrical contact part exposed in an intermediate zone of the cylindrical surface of the cartridge-shaped transducer, between the cylindrical accommodation and the inner end of the said passage, a metal contact means which is connected electrically to the output of said generating circuit and is in sliding contact with said cylindrical contact part of the electrode, and a metal plug which is fixed detachably to the outer end of the said passage and holds said cartridge-shaped transducer axially in place.

2. Emitter according to claim 1, wherein a part of the bore in said tube surrounding the tip of the electrode has a diameter comprised between about 1 mm and about 2 mm.

3. Emitter according to claim 1 or 2, wherein the electrode comprises a cylindrical part which has an outer diameter equal to that of said tube, and which forms said cylindrical contact part, the latter being prolonged axially on one side by a cylindrical part of smaller diameter which is engaged in the bore in said tube and is terminated by said tip, and an insulating piece of cylindrical shape having an outside diameter equal to that of the cylindrical contact part and fixed on the other side of the latter.

4. Emitter according to claim 3, wherein the end of said tube opposite to that which is adjacent to the cylindrical contact part of the electrode, is engaged in the said cylindrical accommodation, and in that the metal horn and its cylindrical accommodation form a heat radiator.

5. Emitter according to claim 4, wherein the end of said tube which is engaged in said accommodation is covered with a thin metal layer on its outer peripheral surface.

6. Emitter according to claim 5, wherein said tube has a circular groove in its peripheral surface, slightly ahead of the tip of the electrode, and wherein the metal layer extends up to the said groove.

7. Emitter according to claim 6, wherein the accommodation has a longitudinal slot in its peripheral wall, and in which a metallic contact member is provided which is fixed to the exterior of said accomodation and is engaged in the said slot and comes in contact with said metal layer.

8. Emitter according to claim 7, wherein between said accommodation and said passage an insulating support is provided, which is pierced with a cylindrical hole in which said transducer is mounted slidably, and in which said metal contact member projects into the interior of the cylindrical hole.

9. Emitter according to claim 3, wherein the tip and said cylindrical part of smaller diameter of the electrode are made of a metal with a high melting point, and in which said cylindrical contact part is formed by a ring made of a good-conducting metal which has an axial length shorter than that of the cylindrical part of smaller diameter, and which is force-fitted on the latter.

10. Emitter according to claim 9, wherein said cylindrical part of smaller diameter is prolonged axially, on the side opposite the tip, by a threaded rod which is screwed into a tapped hole provided in the insulating cylindrical piece.

* * * * *